US007125168B2

(12) United States Patent
La Fleur et al.

(10) Patent No.: US 7,125,168 B2
(45) Date of Patent: Oct. 24, 2006

(54) LARGE CONTAINER HAVING AN OUTER BAG AND INNER LINEAR METHOD OF MANUFACTURING SAME

(75) Inventors: Lee La Fleur, Manistee, MI (US); Jeffrey Delbert Wright, Manistee, MI (US); James Edward Rozmarek, Manistee, MI (US); R. Daniel Brumm, Manistee, MI (US); Aaron Wayne Bryan, Custer, MI (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/323,471

(22) Filed: Dec. 18, 2002

(65) Prior Publication Data

US 2004/0120612 A1 Jun. 24, 2004

(51) Int. Cl.

| | |
|---|---|
| ***B65D 30/08*** | (2006.01) |
| ***B65D 33/14*** | (2006.01) |
| ***B65D 33/00*** | (2006.01) |
| ***B65D 30/20*** | (2006.01) |

(52) U.S. Cl. ..... 383/111; 383/22; 383/41; 383/67; 383/120

(58) Field of Classification Search ..... 383/111, 383/22, 24, 120, 41, 67
See application file for complete search history.

(56) References Cited

U.S. PATENT DOCUMENTS

| | | | | |
|---|---|---|---|---|
| 4,307,764 | A | 12/1981 | Nattrass | |
| 4,390,051 | A * | 6/1983 | Cuthbertson | 383/111 |
| 4,480,766 | A | 11/1984 | Platt | |
| 4,596,040 | A | 6/1986 | La Fleur et al. | |
| 4,597,102 | A | 6/1986 | Nattrass | |
| 4,664,957 | A | 5/1987 | van de Pol | |
| 4,781,472 | A | 11/1988 | La Fleur et al. | |
| 4,781,473 | A | 11/1988 | La Fleur | |
| 4,874,258 | A * | 10/1989 | Marino | 383/111 |
| 4,882,179 | A | 11/1989 | Beyer et al. | |
| 5,104,236 | A | 4/1992 | La Fleur | |
| 5,108,196 | A | 4/1992 | Hughes | |
| 5,158,367 | A | 10/1992 | Derby | |
| 5,161,853 | A | 11/1992 | Polett | |
| 5,165,802 | A | 11/1992 | Derby | |
| 5,192,134 | A | 3/1993 | Polett | |
| 5,222,812 | A | 6/1993 | Cuddy et al. | |
| 5,244,280 | A | 9/1993 | Porter et al. | |
| 5,328,267 | A | 7/1994 | Cuddy et al. | |
| 5,556,205 | A | 9/1996 | Gallie et al. | |
| 5,564,833 | A | 10/1996 | Proffitt | |
| 5,607,237 | A | 3/1997 | LaFleur | |
| 5,685,644 | A | 11/1997 | Taylor | |
| 5,762,421 | A * | 6/1998 | Ross | 383/111 |

(Continued)

*Primary Examiner*—Jes F. Pascua
(74) *Attorney, Agent, or Firm*—Watson IP Group, PLC; Jovan N. Jovanovic; Vladan M. Vasljevic

(57) ABSTRACT

A container comprising an outer bag, a liner and at least one connector. The liner is substantially configured for receipt within the outer bag. The at least one connector is affixed to the liner and capable of attachment to the outer bag. Each such connector comprises a substrate material, an outer bag attachment assembly and an adhesive. The substrate material includes a first region and a second region. The outer bag attachment assembly is associated with a first region. The adhesive is operably applied to the second region. The second region is affixed to one of the at least two side panels, and the first region is selectively positionable to overlie the liner without overlying a portion of the second region or another portion of the first region.

20 Claims, 6 Drawing Sheets

U.S. PATENT DOCUMENTS 5,897,012 A * 4/1999 Sortwell ..... 220/4.28
5,918,984 A 7/1999 LaFleur et al.
5,993,062 A 11/1999 Shackleton
6,010,245 A 1/2000 Ross et al.
6,837,391 B1 * 1/2005 Mino ..... 220/1.6

* cited by examiner

LARGE CONTAINER HAVING AN OUTER BAG AND INNER LINEAR METHOD OF MANUFACTURING SAME

BACKGROUND OF THE INVENTION

1. Field of the Invention

The present invention relates in general to shipping and storage containers, and more specifically, to a large bulk, collapsible container comprising an outer bag and an inner liner, wherein the liner is associated with the outer bag with connectors. The invention is likewise directed to a method of manufacturing same.

2. Background Art

The use of containers having an outer bag and an inner liner has been known in the art. One such example is U.S. Pat. No. 4,781,472 issued to LaFleur et al. Another such example is U.S. Pat. No. 4,596,040 issued to LaFleur et al. The disclosure of each of the foregoing references is incorporated herein in its entirety.

Generally, the prior art discloses large bulk bags and liners receivable in the respective bags wherein the liners are attachable to the bags by connectors. Each such bag is made of a generally flexible woven fiber material and the liner is made of a film or sheet of flexible impervious material. When filled, the bag and liner are generally cubical. When empty the container can be collapsed and folded into a generally flat and compact configuration with the liner in the bag. The liner is generally connected to the bag at selected locations so that when its contents are being discharged, the liner can collapse on itself independently of and without being substantially restrained from collapsing by the bag. Such connections may be detachable from the bag such that the liner can be replaced as desired. In certain embodiments the connector between the bag and the liner comprises a woven or non-woven flexible fabric having an adhesive layer for attachment to the liner at strategic locations. A portion of the connector is free of adhesive and is attached at corresponding strategic locations on the bag.

While such containers have been quite successful, there have been drawbacks relative to their construction and manufacture. For example, in many instances, the connector between the bag and the liner often includes inherent weak regions which lead to failure. In addition, the construction of such connectors and the application of same to the liners has generally been a labor intensive process which increases manufacturing costs and manufacturing time. Indeed, the connector has been one constraint relative to automated liner production.

Accordingly, it is an object of the invention to overcome the deficiencies in the prior art. For example, it is an object of the present invention to provide for a connector which has an improved interface with the liner.

It is an additional object of the invention to provide for a connector which is adaptable to positioning and securement on the associated liner by way of automated assembly equipment, to, in turn, reduce the cost and production time of such a product.

These objects as well as other objects of the present invention will become apparent in light of the present specification, claims, and drawings.

SUMMARY OF THE INVENTION

The invention is directed to a container comprising an outer bag, a liner substantially configured for receipt within the outer bag and a connector (or multiple connectors) connecting the liner and the outer bag. The connector comprises a substrate material, an outer bag attachment assembly and an adhesive. The substrate material includes a first region and a second region. The outer bag attachment assembly is associated with first region. The adhesive is operably applied to the second region. The second region is affixed to the liner, and the first region is selectively positionable to overlie the liner without overlying a portion of the second region or another portion of the first region.

In a preferred embodiment, the liner further comprises at least one side panel and at least one foldable gusseted side panel. In such an embodiment, the second region is substantially fully contained on one of the at least one side panel and the at least one foldable gusseted side panel.

In another preferred embodiment, the substrate material is substantially planar and includes a substantially continuous top and bottom surface.

Preferably, the first region is substantially free of adhesive. Additionally, the first and second regions are positionable in a single plane.

In one embodiment, the adhesive comprises a thickness of substantially between 3 and 7 mills, to, in turn, provide a gap between the first region of the connector and the underlying liner.

It is preferred that the outer bag attachment assembly comprises at least two spaced apart openings extending therethrough.

Additionally, the at least one connector comprises at least four connectors strategically positioned about the liner.

In another aspect of the invention, the invention is directed to a liner of the type identified above having one or more side panels and one or more foldable gusseted side panels and connectors. The connector is of the type identified above relative to the container. Specifically, each connector includes a substrate, an outer bag attachment assembly and an adhesive.

In yet another aspect of the invention, the invention further comprises a method of assembling a liner and connector. The method comprises the steps of providing at least one liner having at least one of a side panel and a foldable gusseted side panel; providing at least one connector, wherein the connector includes a substrate material, an outer bag attachment assembly and an adhesive; and affixing the second region to at least one of the side panel and the foldable gusseted side panel such that the first region of the connector is selectively positionable to overlie the liner without overlying a portion of the second region or another portion of the first region.

In one embodiment, the step of providing at least one connector comprises the step of providing a plurality of connectors. Additionally, the step of affixing comprises the step of affixing the second regions of each of the at least one connector to strategic portions of the at least one liner.

In another aspect of the invention, the invention comprises a method of assembling a plurality of liners and connector comprising the steps of providing a web having a plurality of liners, each liner having at least one of a side panel and a foldable gusseted side panel; providing a plurality of connectors disposed sequentially upon a connector web; sequentially introducing one of the plurality of liners into an applicator assembly; sequentially affixing the second region of each connector to at least one of a side panel and a foldable gusseted side panel such that the first region of the connector is selectively positionable to overlie the liner without overlying a portion of the second region or another portion of the first region; and sequentially discharging the liner having at least one connector attached thereto from the applicator assembly.

BRIEF DESCRIPTION OF THE DRAWINGS

The invention will now be described with reference to the drawings wherein.

DETAILED DESCRIPTION OF THE INVENTION

Figure 1:
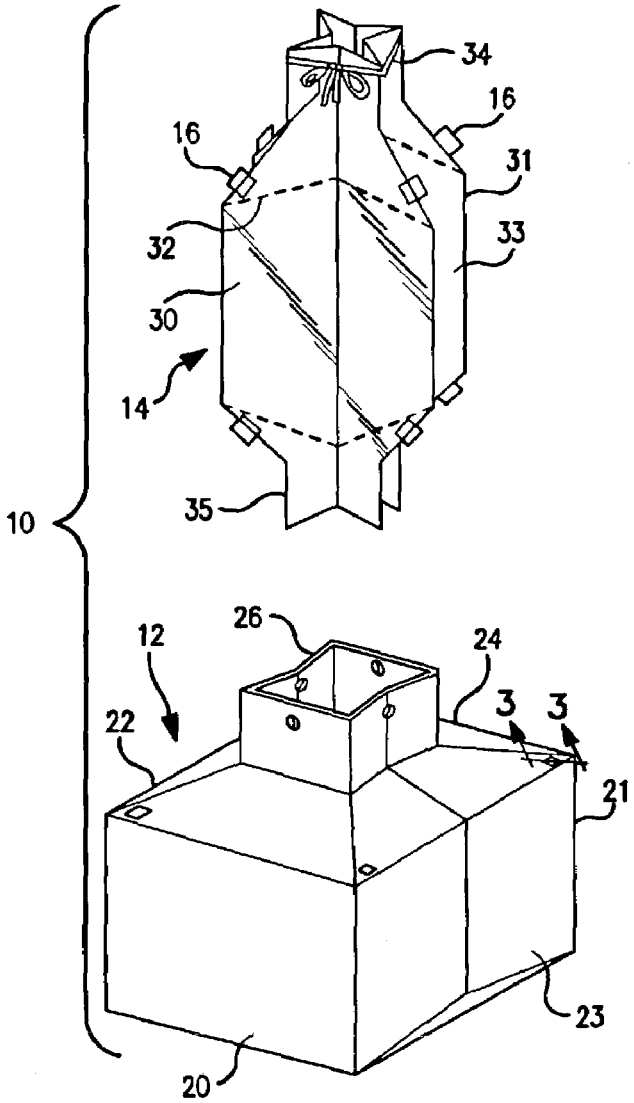
FIG. 1 of the drawings is a perspective view of the container of the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
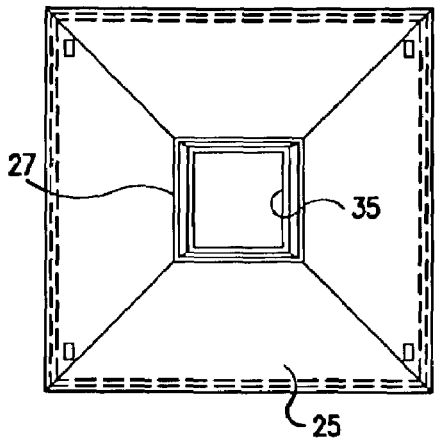
FIG. 2 of the drawings is a bottom plan view of the container of the present invention.
Figure 3:
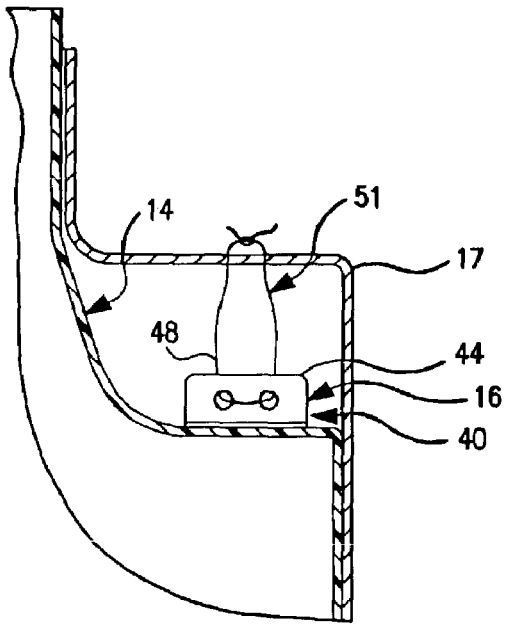
FIG. 3 of the drawings is a partial cross-sectional view of the container of the present invention taken generally about lines 3—3 of FIG. 2.

Referring now to the drawings and in particular to FIG. 1, container 10 comprises outer bag 12, liner 14 and connectors, such as connector 16 which facilitates attachment of liner 14 to outer bag 12 (See, also FIG. 3). Outer bag 12 includes a pair of side panels 20, 21, a pair of gusseted foldable side panels 22, 23, integral ends 24, 25 (FIG. 2) and a pair of spouts 26, 27 (FIG. 2). Side panels 20, 21 are connected by foldable side panels 22, 23 and the integral ends 24, 25. Spout 26 is generally used for filling, and spout 27 is generally used for discharge. It is contemplated, that the outer bag may include only a single spout, wherein the other end is fully closed.

In other applications, the outer bag may have a normally open end which is closed by tying off a portion of the side wall adjacent to such an end. Such bags are disclosed in the '040 patent to LaFleur. Preferably, the outer bag comprises a flexible woven fiber material, such as a polypropylene or polyethylene plastic material. Of course, other synthetic and natural materials are likewise contemplated for use, such as other polymers, or such as fabrics.

Liner 14 is shown in FIG. 1 as comprising a pair of side panels 30, 31, a pair of gusseted foldable side panels 32, 33 and a pair of spouts 34, 35. The side panels 30, 31 are attached by way of the pair of gusseted foldable side panels 32, 33. Spouts 34, 35 are positioned at opposing ends. The pair of side panels and/or the pair of gusseted foldable side panels include connector attachment regions upon which connectors are attached. Liner 14 is configured to correspond to outer bag 12. Specifically, when full, liner 14 is substantially in abutment with and supported by the bag, to, in turn, form a generally cubical position. Similar liners are disclosed in the '040 patent to LaFleur and in the '472 patent to LaFleur. Of course, the individual shapes of the outer bag and the liner are not limited to any particular configuration or to the embodiment shown. It is contemplated that each of the liner and the outer bag may include any number of different combinations of side panels and/or gusseted foldable side panels in any number of configurations.

Figure 4:
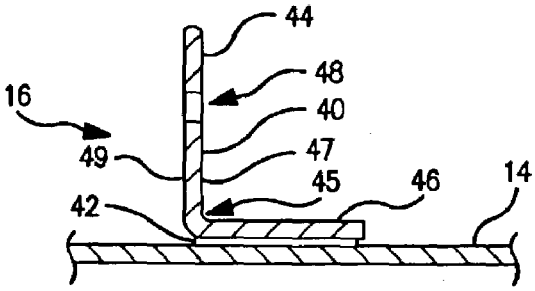
FIG. 4 of the drawings is a partial cross-sectional view of the container of the present invention taken generally about lines 4—4 of FIG. 3.
Figure 6:
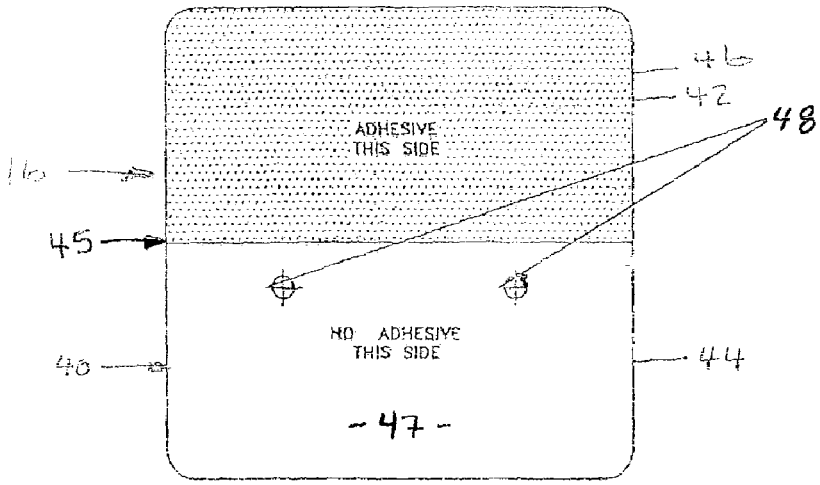
FIG. 6 of the drawings is a top plan view of a connector of the present invention.

Connector 16 is shown in FIGS. 4 and 6 as comprising substrate material 40 and adhesive 42. Substrate material 40 comprises a substantially planar material which includes first region 44 and second region 46 positioned in substantial abutment about a connecting edge, such as connecting edge 45. The first and second regions each include a common top surface 47 and bottom surface 49 (FIG. 4). In the embodiment shown, the top surface and the bottom surface are substantially uniform and continuous between the two regions (i.e., the substrate material in the embodiment shown comprises a single continuous material). As such, the first and second regions are positionable in a single plane. In other embodiments, there may be differences between the top surface and the bottom surface of the two regions.

First region 44 includes liner attachment assembly for attachment thereof to an outer bag. The attachment assembly may comprise at least one opening such as opening 48 positioned thereon and extending therethrough. Adhesive 42 is positioned on at least a portion of one side of second region 46. First region 44 is substantially free of any adhesive. The connector may comprise a woven or non-woven flexible fabric, such as a woven flexible fabric material available from Fabrene, Inc. under product nos. TJJB1B1 and TJRB1B1. Of course, other materials are likewise contemplated for use.

Figure 5A:
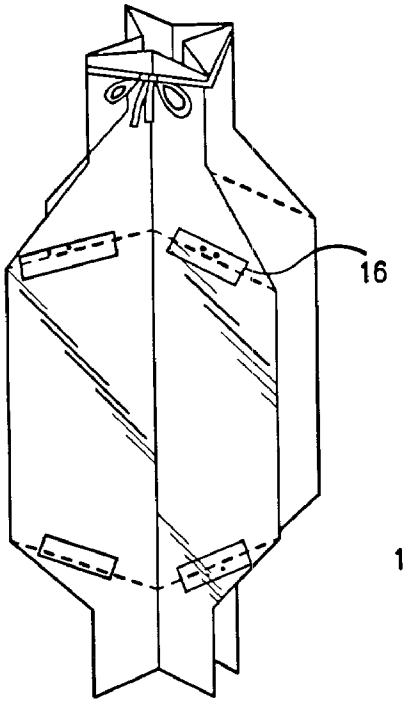
FIG. 5A–5D of the drawings comprises partial perspective views of a liner having connectors in various configurations.
Figure 5B:
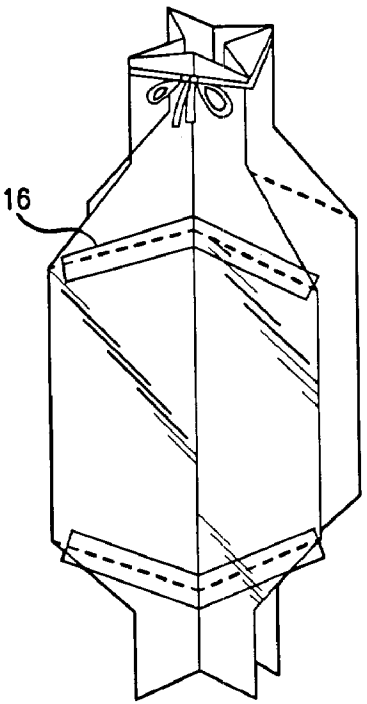

While various embodiments are contemplated for use, in one embodiment, the connectors are about 4" by 4". In another embodiment, as is shown in FIG. 5A, it is likewise contemplated that the connector may have a 4" height and substantially greater width such that they may be applied to extend along a greater width of a panel. Such a construction precludes sagging of the liner within the outer bag upon discharging or filling. For example, and as shown in FIG. 5B, a connector may be of a width that matches the width of a side panel or a gusseted foldable side panel.

It is preferred in certain embodiments that the fabric includes a coating on at least one side thereof to preclude fraying and grinning, and to provide a base upon which the adhesive may readily be applied. In addition, connector 16 may include a certain rigidity which facilitates the connector to have a substantially planar configuration and substantial integrity. Additionally, the connector may comprise a variety of different geometric configurations.

Any number of openings, such as opening 48, may be positioned upon first region 44 (i.e., one, two, three or more openings). Such openings distribute the force about the width of the first region. The openings are capable of interfacing with an outside structure for attachment thereof to the bag. The outside structures may include string 51, or alternatively, tie cords, cables, cable ties, spring latches, hooks, grommets, rings, etc. It has been found that using a pair of openings greatly improves the performance of the connector. In particular, as the liner shifts relative to the outer bag, the two openings improve weight distribution and facilitate improved relative movement of the liner and the outer bag.

It is also contemplated that in certain embodiments, additional adhesive may be applied to the first region for adhering the connector to outer bag 10. In other embodiments, it is contemplated that the connector may be sewn into a seam of the outer bag. In such embodiments, the openings can be eliminated.

The adhesive is applied to the second region of the connector. Preferably, the adhesive is approximately 3 to 7 mills thick, while thicknesses outside of this range are likewise contemplated. The adhesive forms a strong bond with each of the second region and the liner. In turn, and unlike the prior art, the resulting connector does not require two opposing ends to be attached to a liner inasmuch as the combination of the adhesive and the connector tab configuration precludes shear tearing in a first direction, and precludes peeling in a second direction. To the contrary, the prior art generally requires both ends of a connector to be adhered to a liner in an opposing fashion due to relatively poor peelability performance.

The adhesive selected for use between the substrate material and the liner may comprise one which is compatible with the materials, which has adequate physical properties and characteristics, and which is preferably resistant to the forces of shear and peel. Preferably, the adhesive is such that the liner would fail prior to the adhesive and prior to the failure of the substrate material. Of course, other materials are likewise contemplated for use.

Figure 5C:
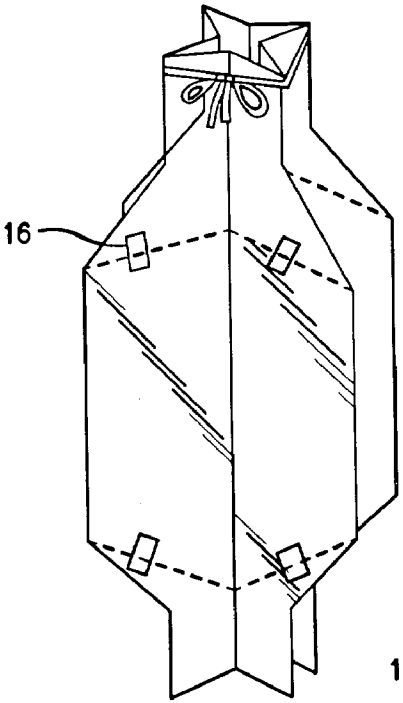
Figure 5D:
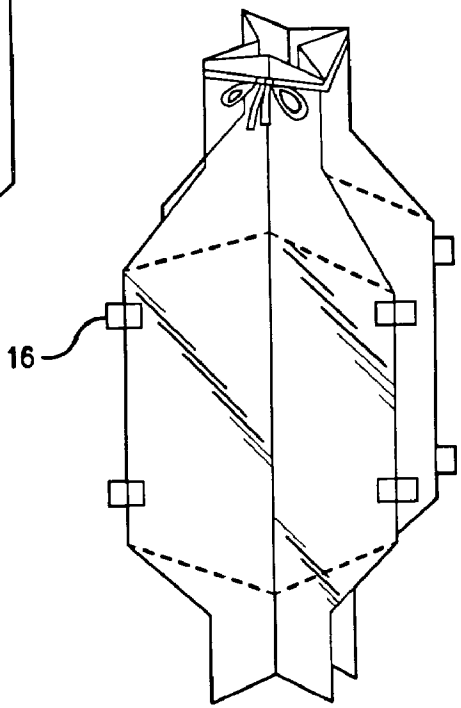

As is shown in FIG. 1, multiple connectors are dispersed at strategic locations (i.e., connector attachment regions) about liner 14. Specifically, a connector is positioned such that second region 46, and adhesive 42 applied thereto, is positioned on one of the side panels or the gusseted foldable side panels and tamped thereon to join same. The connector may be positioned vertically (i.e., wherein the two regions are vertically stacked, FIG. 5C), horizontally, wherein the two regions of the connector are in a side by side orientation, FIG. 5D) or angularly (i.e., as shown in FIG. 1).

The particular quantity of and position of the plurality of connectors is not limited to that which is disclosed in the drawings. Indeed, any number of connectors may be positioned about the side panels and/or the gusseted foldable side panels. Generally, in the embodiment disclosed, the connectors are positioned proximate an edge between side panel and the gusseted foldable side panel at both the upper and lower end thereof. As such a total of four connectors are utilized on each of the side panels for a total of eight connectors. Of course, a greater number or a fewer number of connectors is contemplated for use (i.e., two connectors on each side panel, etc.). In addition, it is certainly contemplated that the connectors may be positioned in any combination upon any of the side panels and the gusseted foldable side panels.

Inasmuch as the present construction permits the use of a connector having one end that attached to the liner and the other end extending therefrom, instead of a loop of material affixed at both ends to the underlying liner, the methods of assembly can be greatly simplified and substantially reduced in cost and effort. Specifically, in addition to the manufacture of the liner and connectors manually, the connectors are well suited for manufacture and attachment by automated machine equipment.

Figure 7:
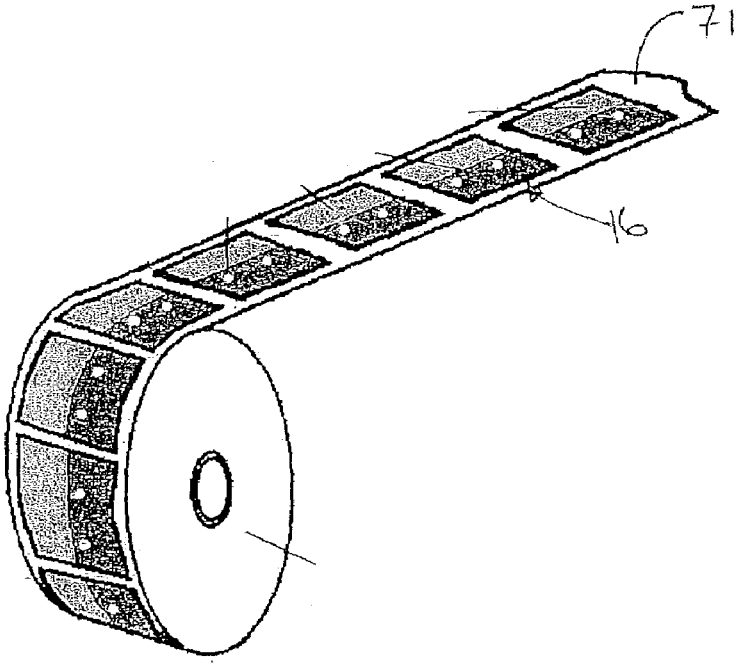
FIG. 7 of the drawings is a perspective view of a web of connectors of the present invention.
Figure 8:
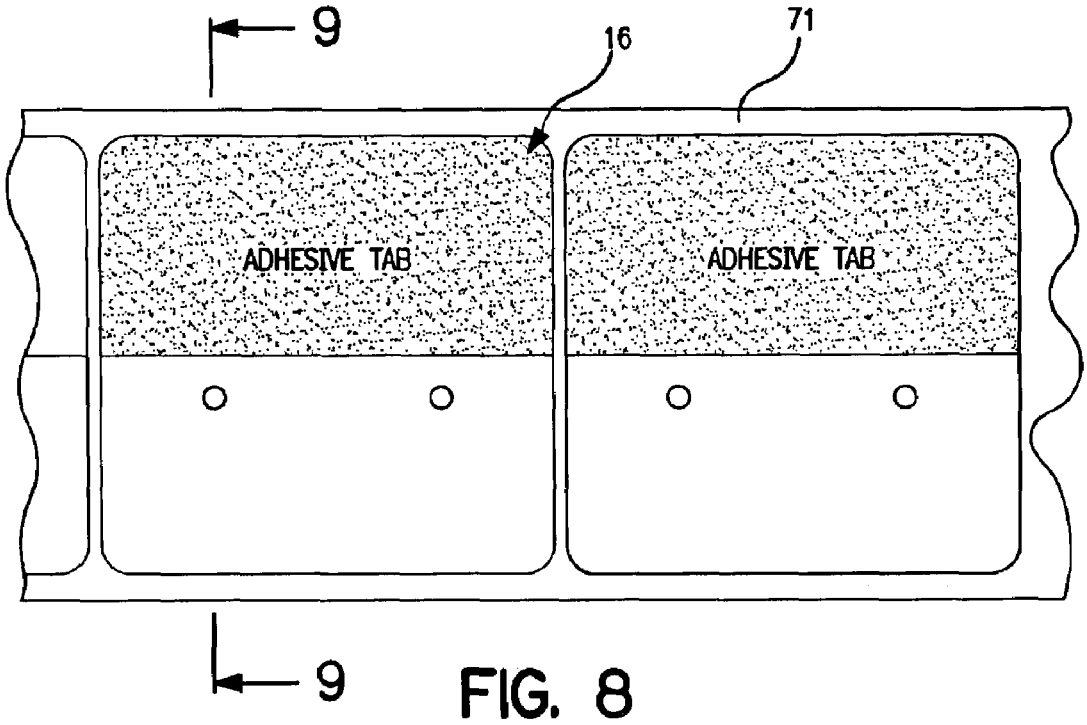
FIG. 8 of the drawings is a top plan view of a portion of the web of connectors of the present invention.
Figure 9:
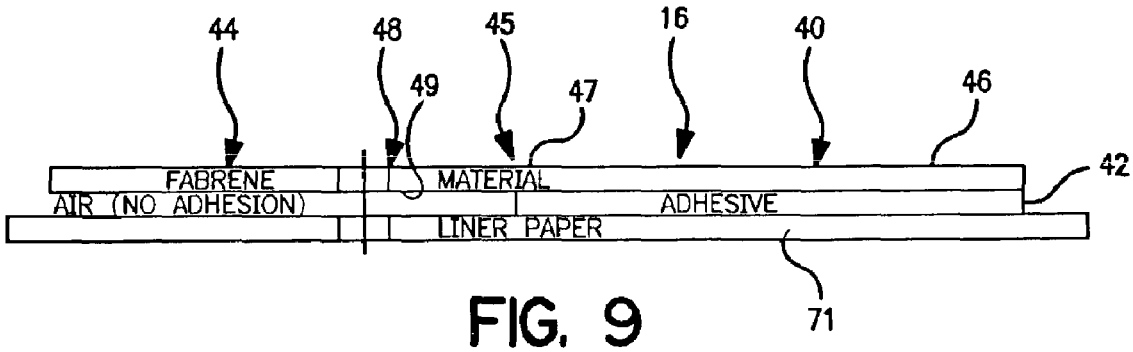
FIG. 9 of the drawings is a cross-sectional view of the web of connectors of the present invention taken generally about lines 9—9 of FIG. 8.

As is shown in FIGS. 7–9, connectors 16 may be disposed on connector web 71 which can be processed into a roll. As is shown in detail in FIG. 8, connector web 71 comprises a liner paper having connectors substantially linearly disposed thereon. Referring to FIG. 9, each connector is releasably retained to the liner paper by the adhesive positioned below the second region thereof. As such, a gap is present between the liner paper and the first region of the connector when the connector is attached to connector web 71 (and such a gap is likewise present between portions of the first region relative to the liner upon application of the connector to the liner).

Figure 10:
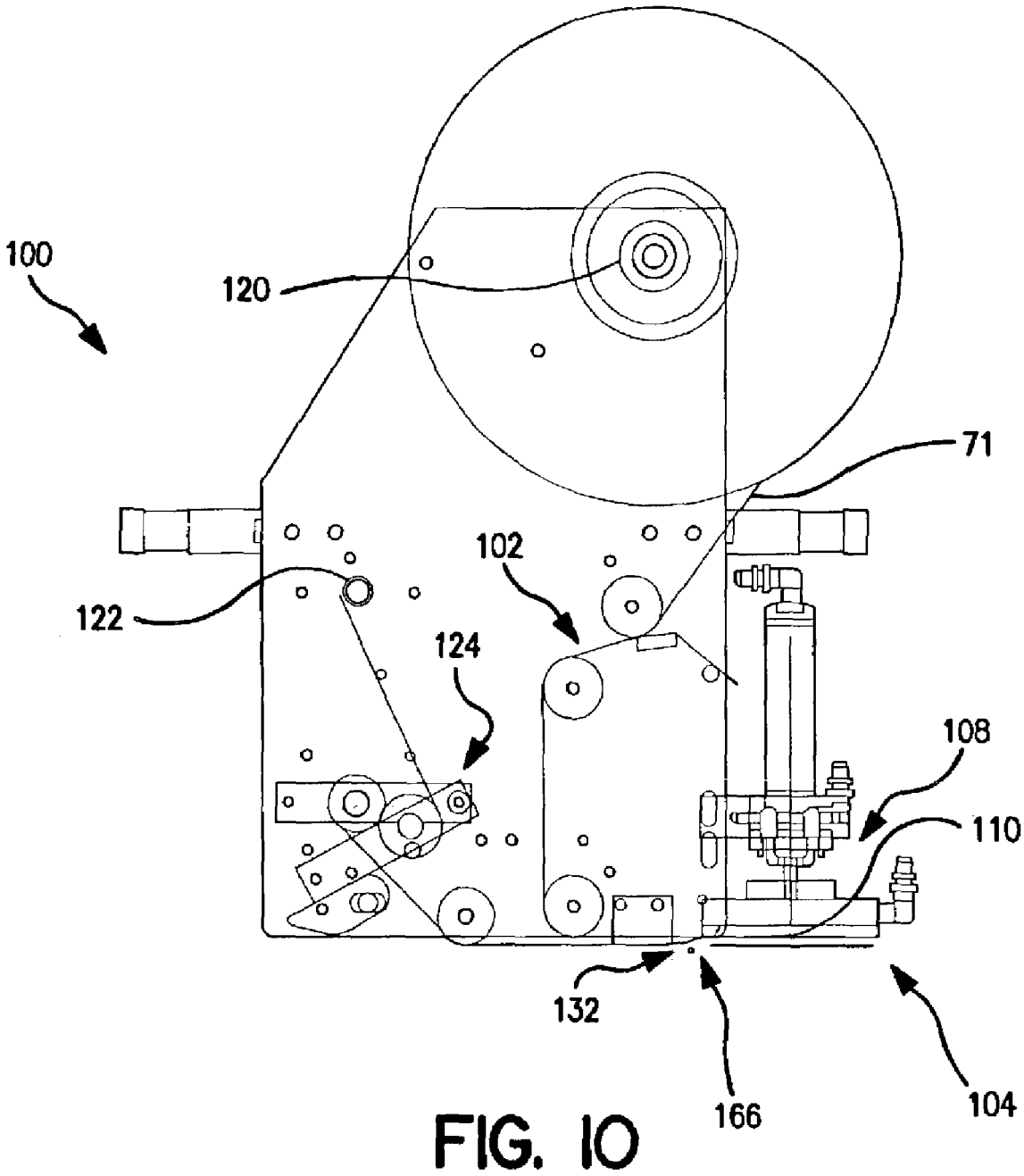
FIG. 10 of the drawings is a side elevational view of one embodiment of an applicator assembly.

Referring now to FIG. 10, in one manufacturing method, the invention further comprises applicator assembly 100 for applying at least one connector to a liner in a predetermined position and orientation. The applicator assembly includes means 102 for advancing the connector web, means 104 for advancing the liner, means 106 for removing the connector from the web, means 108 for positioning the connector relative to the liner and means 110 for attaching the connector to the liner.

In the embodiment shown, means 102 for advancing the connector web comprises first axle 120, second axle 122 and feed assembly 124. First rotating axle 120 is configured to receive and retain connector web 71 in a rolled-up position. Feed assembly 124 is controlled such that the connector web proceeds from first axle 120 to the connector removing means at a desired speed. Subsequently connector web with connectors removed is then received by second rotating axle 122, under the direction of the feed assembly.

Means 104 for advancing the liner may comprise a conveyor or other suitable drive mechanism for directing the liners continuously or in an indexed fashion toward and into operative position relative to the applicator assembly. In addition, the liner advancing means directs the liner away from the applicator assembly after application of the connector thereto, so that a subsequent liner can be introduced to the applicator assembly. In one embodiment, it is contemplated that a plurality of liners may be attached side to side or end to end to form a continuous web of liners. In other embodiments, the liners may be separate members which are sequentially advanced through the applicator assembly.

Means 106 for removing the connector from the web comprises a variety of different members capable of removing an individual connector from the web. For example, in the embodiment shown, pins 132 are associated with the connector web advancing means such that the underlying web is directed through a sharp bend around pins 132. As such, while the underlying web is capable of proceeding around the sharp bend, the relatively more rigid connector begins to detach from the underlying web. Continued movement of the web about the bend eventually releases the connector therefrom.

Positioning means 108 comprises a flat plate positioned proximate pins 132 of the connector removing means. The positioning means 108 comprises a plate having a vacuum applied to portions of the surface of the plate. The plate is positioned such that as the connector is detached from the underlying web, the connector is drawn into contact with the plate and maintained in such contact with the plate by the vacuum applied thereto. Continued movement of the web, directs the connector along the plate. By the time that the connector fully disconnects from the underlying web, the connector has properly advanced along the flat plate of the positioning means into the proper orientation for application onto the liner.

Once positioning means 108 locates the connector in the desired orientation and position relative to the liner, the attaching means 110 is activated. In particular, the attaching means forces directs the flat plate toward the liner such that the connector (having adhesive thereon) is attached to the liner. Additional pressure can be applied to the plate to tamp or otherwise presses the connector against the liner to adhere the two components together. Once the connector has been attached, the vacuum applied to the plate can be abated and the plate can be retracted to its original position. As the plate retracts, the connector remains connected to the liner and becomes detached from the plate.

The plate returns to a position wherein it can accept a subsequent connector for application onto a liner. It is contemplated that the connectors can be applied to side panels or foldable gusseted side panels as desired. Wherein the connector is applied to a foldable gusseted side panel, the applicator assembly may include additional assemblies to expose the region of the foldable gusseted side panel, to, in turn, facilitate the attachment of a connector thereto.

Figure 11B:
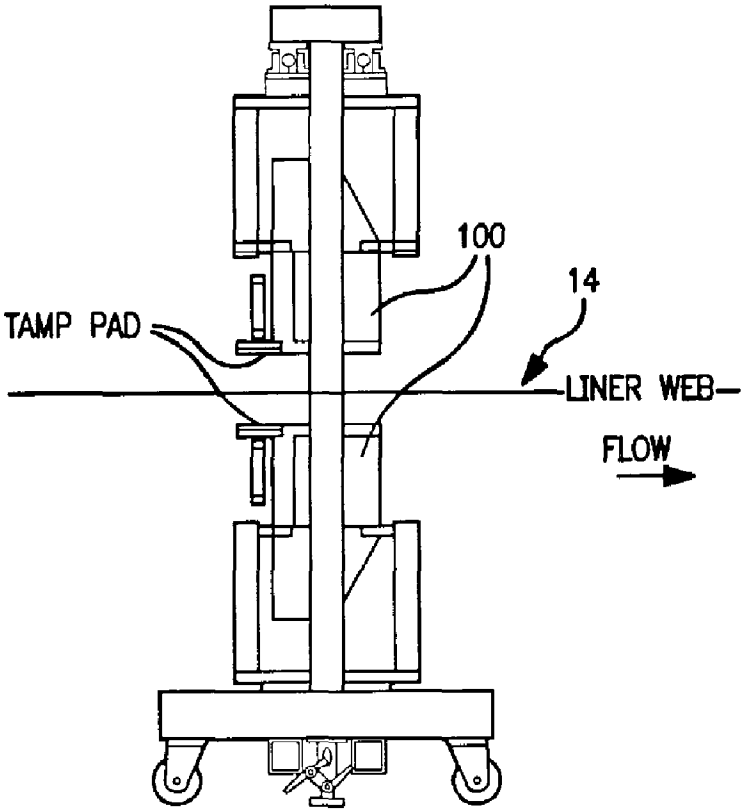
FIG. 11B of the drawings is a side elevational view of the embodiment of the applicator machine shown in FIG. 11A.
Figure 11A:
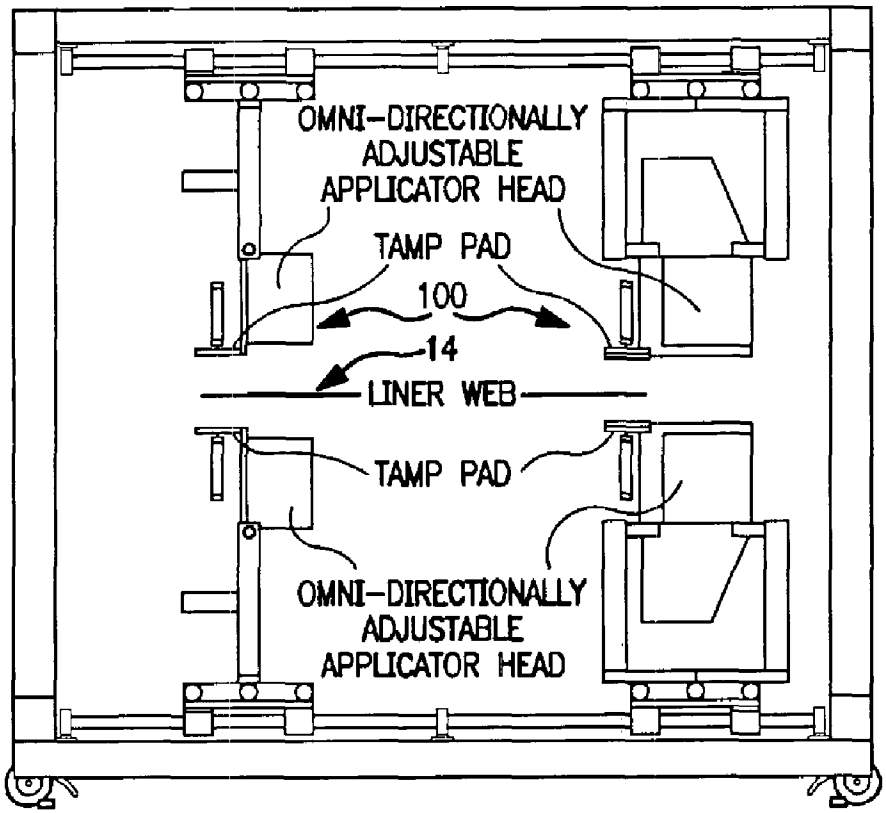
FIG. 11A of the drawings is a front plan view of one embodiment of an applicator machine having a plurality of applicator assemblies.

Referring now to FIGS. 11A and 11B, it is contemplated that an applicator machine may be configured with multiple applicator assemblies such that multiple connectors can be positioned on different surfaces simultaneously (i.e., certain connectors may be applied to one side panel while other connectors are applied to the other side panel, or to the foldable gusseted panels). For example, opposing applicator assemblies may be positioned on opposing side panels such that the connectors are simultaneously applied to the liner in the same position on opposing side panels. Advantageously, wherein the applicator assemblies are positioned on opposing sides of a liner, the plates of the opposing applicator assemblies can cooperate to sandwich connectors therebetween, enhancing the compressive force on the adhesive, which, in turn, enhances the bond between the liner and the connector.

With respect to the applicator machine of FIGS. 11A and 11B, it is contemplated that the each applicator assembly can be easily rotated to accommodate the application of tabs which are horizontal, vertical or angled relative to the liner. Additionally, it is contemplated that each applicator assembly can be rotated such so as to facilitate the application of connectors to foldable gusseted side panels. The particular number of application assemblies and the particular orientation of same can be varied to achieve desired results.

Certain tests were conducted relative to a liner and connector constructed in accordance with the present disclosure as compared to a liner and connector of the type disclosed in the '472 patent to LaFleur. The construction of the liner and connector in accordance with the present invention exhibited comparable strength as the prior art liner and connector regardless of orientation in the shear and in the peel orientations. While the strength is comparable, the costs and manufacturing times of the liner and connector made in accordance with the present invention are greatly improved relative to the prior art liner and connector.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A container comprising:

an outer bag having at least one side panel, a top and a bottom;

a liner positioned within the outer bag, the liner including a plurality of sides, a top and a bottom so as to substantially correspond to the outer bag;

at least one connector comprising a uniformly planar, substantially rigid woven fabric having a first region and a second region adjacent to the first region, wherein the second region of the at least one connector is attached to the liner with an adhesive, wherein the strength of the adhesive between the at least one connector and the liner is stronger than the liner, to, in turn, facilitate the failure of the liner prior to the failure of the adhesive bond and wherein first region of the connector is attached to the outer bag.

2. The container of claim 1 wherein the inner liner further comprises two pairs of side panels, one of the two pairs of side panels are gusseted.

3. The container of claim 1 wherein the top includes a spout and wherein the bottom includes a spout.

4. The container of claim 1 wherein the at least one connector comprises a square connector, and wherein the first region and the second region are substantially the same size.

5. The container of claim 1 wherein the first region of the at least one connector includes at least two spaced apart openings for attachment of the at least one connector to the outer bag with at least one of string, tie cords, cables and cable ties.

6. The container of claim 1 wherein the at least one connector comprises eight spaced apart connectors.

7. The container of claim 1 wherein the adhesive comprises a thickness of substantially between 3 and 7 mills so as to offset the at least one connector from the liner.

8. A liner substantially configured for receipt within an outer bag comprising:

a plurality of sides, a top and a bottom so as to substantially corresponding to an outer bag;

at least one connector comprising a uniformly planar, substantially rigid woven fabric having a first region and a second region adjacent to the first region, wherein the second region of the at least one connector is attached to the liner with an adhesive wherein the strength of the adhesive between the at least one connector and the liner is stronger than the liner, to, in turn, facilitate the failure of the liner prior to the failure of the adhesive bond therebetween and wherein the first region of the connector is configured so as to attach to an outer bag.

9. The liner of claim 8 further comprising two pairs of side panels wherein one of the two pairs of side panels are gusseted.

10. The liner of claim 8 wherein the top includes a spout and wherein the bottom includes a spout.

11. The liner of claim 8 wherein the at least one connector comprises a square connector, and wherein the first region and the second region are substantially the same size.

12. The liner of claim 8 wherein the at least one connector includes at least two spaced apart openings, and wherein at least one of string, tie cords, cables and cable ties extending through each of the pair of spaced apart openings.

13. The liner of claim 8 wherein the at least one connector comprises eight spaced apart connectors.

14. The liner of claim 8 wherein the adhesive comprises a thickness of substantially between 3 and 7 mills so as to offset the at least one connector from the liner.

15. A container comprising:

an outer bag having at least one side panel, a top and a bottom;

a liner positioned within the outer bag, the liner including a plurality of sides, a top and a bottom so as to substantially correspond to the outer bag;

at least one connector comprising a uniformly planar, substantially rigid woven fabric having a first region with at least two spaced apart openings and a second region adjacent to the first region, wherein the second region of the at least one connector is attached to the liner with an adhesive and wherein the first region of the at least one connector is attached to the outer bag by way of the at least two spaced apart openings with at least one of string, tie cords, cables and cable ties.

16. The container of claim 15 wherein the at least one connector comprises eight spaced apart connectors.

17. The container of claim 15 wherein the strength of the adhesive between the at least one connector and the liner is stronger than the liner, to, in turn, facilitate the stretching of the liner prior to the failure of the adhesive bond.

18. A liner substantially configured for receipt within an outer bag comprising:

a plurality of sides, a top and a bottom so as to substantially corresponding to an outer bag;

at least one connector comprising a uniformly planar, substantially rigid woven fabric having a first region with at least two spaced apart openings and a second region adjacent to the first region, wherein the second region of the at least one connector is attached to the liner with an adhesive; and at least one of string, tie cords, cables and cable ties extending through the at least two spaced apart openings for attachment thereof to an outer bag.

19. The liner of claim 18 wherein the at least one connector comprises eight spaced apart connectors.

20. The liner of claim 18 wherein the strength of the adhesive between the at least one connector and the liner is stronger than the liner, to, in turn, facilitate the stretching of the liner prior to the failure of the adhesive bond therebetween.

* * * * *